US011256218B2

(12) United States Patent
Heinz

(10) Patent No.: US 11,256,218 B2
(45) Date of Patent: Feb. 22, 2022

(54) CHRONOGRAPH AND ZEROING DEVICE FOR THE MINUTE HAND OF A CHRONOGRAPH

(71) Applicant: Uwe Heinz, Manching (DE)

(72) Inventor: Uwe Heinz, Manching (DE)

( * ) Notice: Subject to any disclaimer, the term of this patent is extended or adjusted under 35 U.S.C. 154(b) by 567 days.

(21) Appl. No.: 16/218,877

(22) Filed: Dec. 13, 2018

(65) Prior Publication Data

US 2019/0187626 A1 Jun. 20, 2019

(30) Foreign Application Priority Data

Dec. 18, 2017 (DE) ..... 20 2017 107 668.7

(51) Int. Cl.
*G04F 7/08* (2006.01)
*G04B 11/04* (2006.01)

(52) U.S. Cl.
CPC ..... *G04F 7/0804* (2013.01); *G04B 11/04* (2013.01); *G04F 7/0814* (2013.01); *G04F 7/0823* (2013.01)

(58) Field of Classification Search
CPC ..... G04F 7/0804; G04F 7/0814; G04F 7/0823
See application file for complete search history.

(56) References Cited

U.S. PATENT DOCUMENTS 5,793,708 A * 8/1998 Schmidt ..... G04F 7/0814 368/106
7,029,169 B2 * 4/2006 Takahashi ..... G04F 7/0819 368/106
9,164,492 B2 * 10/2015 Philippine ..... G04F 7/0809
2008/0310258 A1 * 12/2008 Trifoni ..... G04B 3/048 368/106
2009/0086583 A1 * 4/2009 Wyssbrod ..... G04F 7/0814 368/106
2013/0148476 A1 * 6/2013 Mertenat ..... G04F 7/0814 368/103

* cited by examiner

*Primary Examiner* — Edwin A. Leon
*Assistant Examiner* — Jason M Collins
(74) *Attorney, Agent, or Firm* — Frank H. Foster; Kremblas & Foster

(57) ABSTRACT

A zeroing device (200), including a first zeroing unit (71), which consists of a zeroing lever (12) having a zeroing lever arm (12*a*) and a zeroing lever latch (12*b*), wherein the zeroing lever latch (12*b*) has a first end (13) and a second end (14).
The zeroing device is characterized by a second zeroing unit (72) that is arranged at an offset to the first zeroing unit (71) in a Z coordinate direction (Z) and is in operative connection with the first zeroing unit (71). The second zeroing unit (72) may also include a pendulum rod (31), a hinge support (34), and a joint rod (35), wherein the pendulum rod (31) is rotatably attached to a cam (33) and to the joint rod (35) and wherein the joint rod (35) is rotatably attached to the hinge support (34) and rests against an eccentric (36) of the zeroing lever (12).

15 Claims, 11 Drawing Sheets

CHRONOGRAPH AND ZEROING DEVICE FOR THE MINUTE HAND OF A CHRONOGRAPH

The present invention relates to a zeroing device for the minute hand of a chronograph. The zeroing device consists of a first zeroing unit, which consists of a zeroing lever having a zeroing lever arm and a zeroing lever latch. The zeroing lever latch has a first end and a second end.

The present invention further relates to a chronograph.

Particularly, the chronograph includes a second wheel with an entraining spring. Furthermore, a pulse-receiving wheel is provided, wherein the entraining spring is configured for engaging in the pulse-receiving wheel. A zeroing wheel is in constant engagement with the drive wheel. A minute wheel is in constant engagement with a pulse-transmitting wheel, and a center minute hand is firmly connected to the minute wheel. The second wheel is firmly connected to a second shaft, and a center second hand is firmly connected to the second shaft. A multifunction shaft is aligned parallel to the second shaft. The pulse-receiving wheel and the pulse-transmitting wheel are firmly coaxially connected to the multifunction shaft. A first zeroing unit consists of a zeroing lever having a zeroing lever arm and a zeroing lever latch. The zeroing lever latch has a first end and a second end, wherein the first end can be brought into and out of an operative connection with a heart-shaped minute zeroing cam the zeroing wheel and the second end can be brought into and out of an operative connection with a heart-shaped second zeroing cam of the second wheel.

A mechanical clockwork comprises as its central components a spring barrel with mainspring, gear mechanism, escapement, and oscillating system (balance wheel). The spring barrel with mainspring provides the drive of the clockwork. Power is transmitted from the spring barrel via the gear mechanism to the escape wheel, which is a component of the escapement. The gear mechanism drives the hands of the watch and translates the spring force stored in the mainspring into rotational movements of different speeds, whereby seconds, minutes, and hours, etc. are indicated.

BACKGROUND OF THE INVENTION

U.S. Pat. No. 3,903,686 discloses a chronograph having a second hand, a minute hand, and an hour hand, wherein these hands are combined with a minute and hour counter and have the property that the second hand, the minute counter, and the hour counter can be reset to zero.

The German translation DE 698 30 930 T2 of European patent EP 1 046 970 B1 discloses an intermittent feeding mechanism in which a feed pawl with a spring portion is provided on a first counting wheel. The feed pawl rotates together with a first counting wheel, such that every turn of said feed pawl engages a gear of a second counting wheel or a second counting intermediate wheel, thereby intermittently advancing said second counting wheel or said second counting intermediate wheel. A protruding portion is provided on the feed pawl of this intermittent feed mechanism, wherein a positioning hole is provided in a structural member of the first counting wheel. The feed pawl is positioned when the protruding portion is inserted in the positioning hole and the protruding portion is driven into the positioning hole by a spring portion of the feed pawl.

A chronograph, such as the "ETA Valjoux 7750" clockwork, comprises at least a second hand and a minute hand, which can be stopped, reset to zero, and restarted, if desired.

The time interval measured by means of a chronograph can be displayed by separate second and minute dials or by means of second and minute hands arranged coaxially with the actual hands of the watch. If the hands are arranged coaxially, they are called a center second hand and a center minute hand.

German patent DE 10 2013 103 180 B4 describes a chronograph having a center second hand and a center minute hand. The chronograph comprises a second wheel with an entraining spring and a pulse-receiving wheel, wherein the entraining spring is configured to engage in the pulse-receiving wheel. Furthermore, a drive wheel and a zeroing wheel are provided, wherein the zeroing wheel is in constant engagement with the drive wheel. The chronograph also includes a pulse-transmitting wheel and a minute wheel, wherein the minute wheel is in constant engagement with the pulse-transmitting wheel and the center minute hand is firmly connected to the minute wheel. Finally, a second shaft is provided, wherein the second shaft and the center second hand are firmly connected to the second shaft. An aligned multifunction shaft is provided parallel to the second shaft, wherein pulse-receiving wheel, drive wheel, and pulse-transmitting wheel are firmly connected to the multifunction shaft. Another component of the chronograph is the two-piece pivoted zeroing lever, which can be brought into and out of engagement with the heart-shaped minute zeroing cam and the heart-shaped second zeroing cam to effect positioning or resetting the center minute hand to zero.

It is a disadvantage of prior art zeroing devices that a full reset to zero of the center minute hand and the center second hand cannot always be achieved by operating the reset pushbutton once. A full reset of center minute hand and center second hand to zero requires operating the reset pushbutton at least twice. There is also the risk that excessive application of force via the reset pushbutton can damage the linkage.

To solve the problems mentioned above, it is an object of the invention to provide a zeroing device with which a reliable and permanently unambiguous zeroing of the center minute hand and the center second hand can be achieved by operating the reset pushbutton once.

It is another object of the invention to provide a chronograph in which a reliable and permanently unambiguous zeroing of the center minute hand and the center second hand can be achieved by operating the reset pushbutton once.

SUMMARY OF THE INVENTION

The zeroing device according to the invention consists of a first zeroing unit, which consists of a zeroing lever having a zeroing lever arm and a zeroing lever latch. The zeroing lever latch has a first end and a second end. The zeroing device is provided with a second zeroing unit, which is arranged above the first zeroing unit in the Z coordinate direction and in operative connection with said first zeroing unit.

The major advantage of this invention is that the two zeroing mechanisms, which are both in use and in operative connection, allow zeroing of the heart-shaped minute zeroing cam and the heart-shaped second zeroing cam by means of a spring-loaded zeroing lever latch. Furthermore, the force from the reset pushbutton is indirectly diverted via the cam and the second zeroing unit placed upon the cam to the zeroing lever latch, such that it can be manually pressed into the zero position.

The second zeroing unit includes a pendulum rod, a hinge support, and a joint rod. The pendulum rod is rotatably attached to a cam and to the joint rod. The joint rod is rotatably attached to the hinge support and rests against an eccentric of the zeroing lever. The joint rod itself is mounted in a stationary manner. As mentioned above, the first and second zeroing devices make it possible to convert a rotational movement of the control cam into a directed pushing motion onto the heart-shaped minute zeroing cam and the heart-shaped second zeroing cam. The cam itself sits on a control cam and is connected to it in a stationary manner. The control cam interacts with the zeroing lever arm of the zeroing lever.

The zeroing lever latch is designed such that its first end is angled and its second end is flattened. In a zero position, the first, angled end of the zeroing lever latch rests against a flattened area of the heart-shaped minute zeroing cam of a minute wheel. The second, flattened end of the zeroing lever latch rests against a flattened area of the heart-shaped second zeroing cam of a second wheel. It is advantageous that the current invention splits the zeroing path or zeroing movement between the two systems (the first zeroing unit and the second zeroing unit), even at increased friction due to multiple rotation and the associated forced spring deflection of gear wheels.

The zero position of the center second hand and the center minute hand is caused in that a cam contour of the control cam engages in a U-shaped receptacle on the zeroing lever arm of the zeroing lever by a rotational movement of the control cam. The rotational movement of the control cam further applies a force via the pendulum rod and the joint rod onto the eccentric of the zeroing lever, such that the first, angled end of the zeroing lever latch rests against the flattened area of the heart-shaped minute zeroing cam of the minute wheel and the second, flattened end of the zeroing lever latch rests against the flattened area of the heart-shaped second zeroing cam of the second wheel. The two zeroing units thus always ensure that zeroing of the center second hand and the center minute hand is achieved by bringing the flattened areas of the heart-shaped minute zeroing cam and the heart-shaped minute zeroing cam to rest against the first end or second end of the zeroing lever latch, respectively. The zero position can be initiated by operating a reset pushbutton. Operating the reset pushbutton in an axial direction causes the rotational movement of the control cam via a transmission mechanism.

The chronograph includes a second wheel with an entraining spring and a pulse-receiving wheel, wherein the entraining spring is configured to engage in the pulse-receiving wheel. Furthermore, a zeroing wheel is provided, wherein the zeroing wheel is in constant engagement with the drive wheel. A pulse-transmitting wheel of the chronograph is in constant engagement with a minute wheel, and a center minute hand is firmly connected to the minute wheel. The chronograph includes a second shaft, wherein the second shaft and a center second hand are firmly connected to the second shaft. A multifunction shaft is aligned parallel to the second shaft, wherein the pulse-receiving wheel and the pulse-transmitting wheel are firmly coaxially connected to the multifunction shaft. A first zeroing unit, which consists of a zeroing lever having a zeroing lever arm and a zeroing lever latch, is provided for resetting the center second hand and the center minute hand to zero. The zeroing lever latch has a first end and a second end. The first end can be brought into and out of an operative connection with a heart-shaped minute zeroing cam of the zeroing wheel and the second end can be brought into and out of an operative connection with a heart-shaped second zeroing cam of the second wheel. According to the invention, a second zeroing unit is arranged above the first zeroing unit, such that the second zeroing unit supports the first zeroing unit when the reset pushbutton is operated. This has the advantage that the first zeroing unit and the second zeroing unit are simultaneously in use when the reset pushbutton is operated. The two zeroing units thus convert a rotational movement of the control cam into a directed pushing motion of the two zeroing units. The additional force of the second zeroing unit thus ensures that the center minute hand and the center second hand are reset to zero.

The heart-shaped minute zeroing cam is firmly connected to the zeroing wheel via a zeroing shaft. The heart-shaped second zeroing cam is firmly connected to the second wheel via a second shaft.

The second zeroing unit is configured in such a way that it includes a pendulum rod, a hinge support, and a joint rod. The pendulum rod is rotatably attached to a cam and to the joint rod for the functioning of the second zeroing unit. The joint rod is rotatably attached to the hinge support and rests against an eccentric of the zeroing lever. The joint rod is installed in a stationary manner into the chronograph.

Various other objects, advantages, and features of the present invention will become apparent from the following detailed description, and the novel features are particularly emphasized in the appended claims.

The present invention is apparent to a person skilled in the art from the following description in conjunction with the appended drawings, wherein the embodiments are not meant to limit the present invention.

BRIEF DESCRIPTION OF THE SEVERAL VIEWS OF THE DRAWING(S)

DETAILED DESCRIPTION OF THE INVENTION

The present invention will now be described in greater detail with reference to the following embodiments. Identical reference symbols were used in the figures for similar elements of the invention or elements of the invention that act similarly. Furthermore, the respective figures, for the sake of clarity, only include reference symbols which are required for describing the respective figure. The embodiment shown just represents examples of how the zeroing device according to the invention or the chronograph including the zeroing device according to the invention can be configured; these figures should not be viewed as a concluding limitation of the invention. The relative dimensions of the individual elements in the figures do not always match the actual relative dimensions, since some shapes were simplified and other shapes were enlarged with respect to other elements for improved illustration. It is understood that aspects of the present disclosure, as generally described herein and represented in the figures, can be arranged, combined, separated, and configured in a multitude of different configurations, all of which are explicitly considered herein. It is likewise understood that each reference to a first, second, etc. element in the claims or in the detailed description is not intended to imply a numerical sequence but meant to distinguish one element from another element, unless such numbering is explicitly designated as a numerical sequence.

Figure 1:
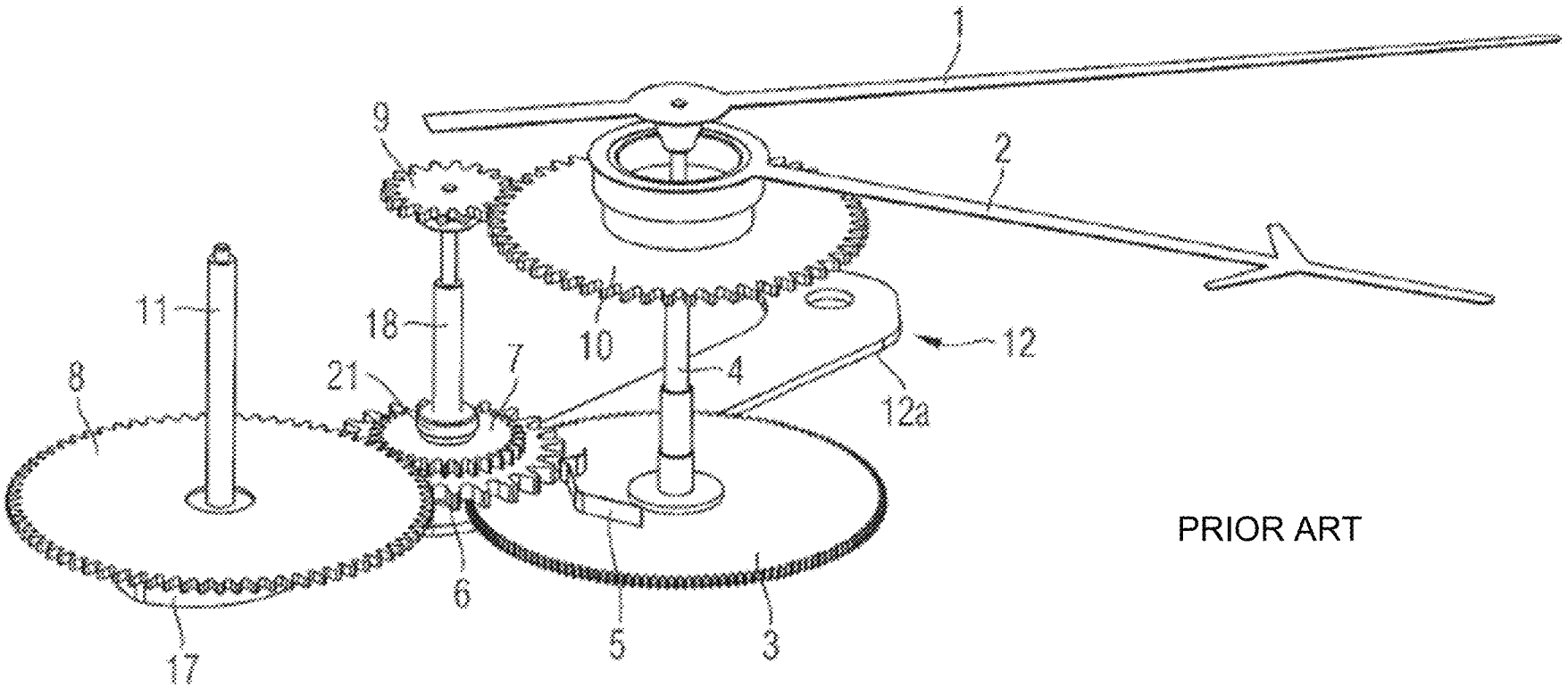
PRIOR ART FIG. 1
FIG. 1 shows a perspective view from the top of a portion of the internal structure of a chronograph according to prior art.

FIG. 1 shows a perspective partial view of a chronograph from the top. The chronograph is driven by a swivel drive (not shown), which brings the gear mechanism of the watch into engagement with the second wheel 3. According to the invention, the pulse-receiving wheel 6 and the drive wheel 7, which is arranged coaxially above, are firmly connected to a multifunction shaft 18, which itself is mounted in a bottom plate (not shown) arranged above the drive wheel 7 in the ruby bearing stone 21. Also firmly connected to the multifunction shaft 18 is the pulse-transmitting wheel 9, which is in constant engagement with the minute wheel 10.

The section of the entraining spring 5 that faces away from the pulse-receiving wheel 6 is firmly connected to the second wheel 3. The section of the entraining spring 5 that faces the pulse-receiving wheel 6 is of a resilient design and intended to engage in the pulse-receiving wheel 6. The zeroing wheel 8, which is firmly connected to the zeroing shaft 11, is in constant engagement with the drive wheel 7. The zeroing shaft 11 is mounted in a bottom plate (not shown). After one complete revolution of the second wheel 3, the pulse-receiving wheel 6 is indexed by one subunit by the entraining spring 5. The zeroing wheel 8, the pulse-transmitting wheel 9, and the minute wheel 10 are indexed by the drive wheel 7, whereby the center minute hand 2 is eventually advanced by one unit.

The center second hand 1 is firmly connected to the second shaft 4, wherein the second shaft 4 itself is firmly connected to the second wheel 3. The second shaft 4 penetrates the center of the minute wheel 10. The swivel drive (not shown) ensures direct drive of the second wheel 3, wherein the center second hand 1 is also moved via the second shaft 4.

Figure 2:
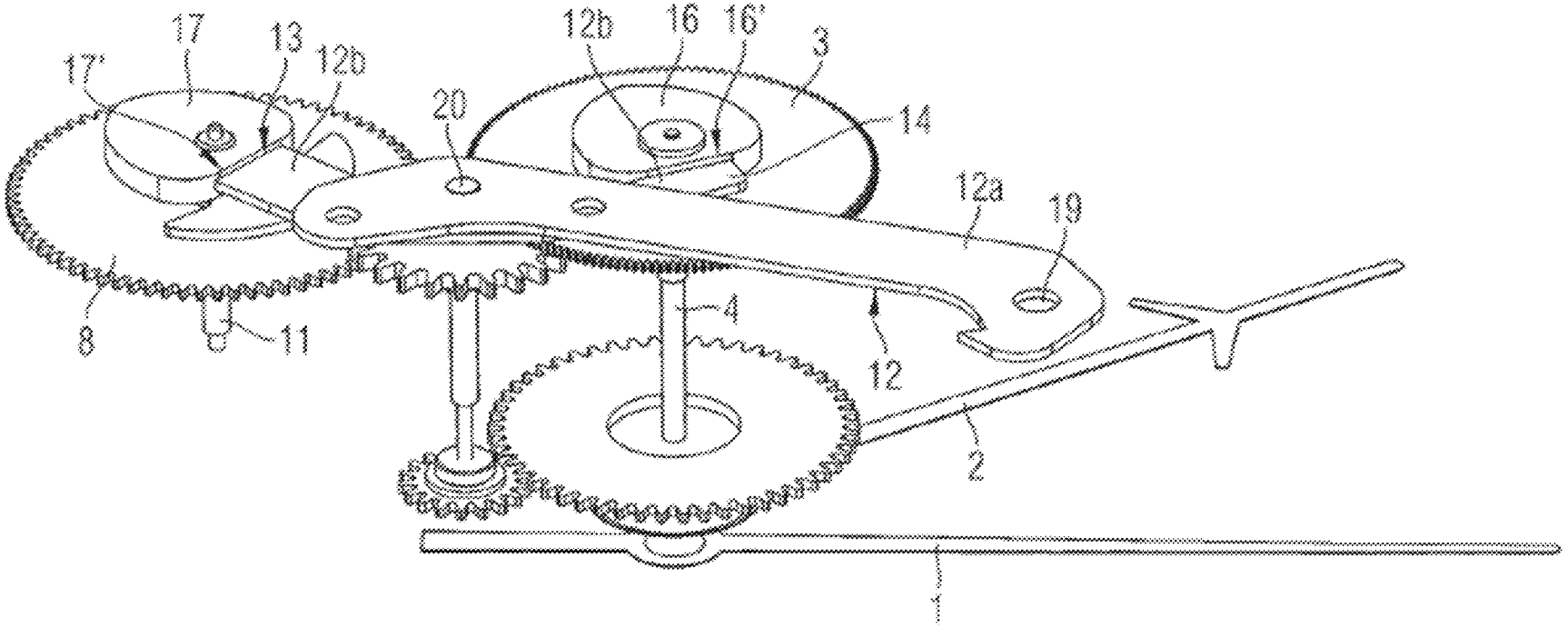
PRIOR ART FIG. 2
FIG. 2 shows a perspective view from the bottom of a portion of the internal structure of a chronograph from FIG. 1.

Another component of the chronograph is the zeroing lever 12, which is of a two-piece design and rotatably mounted and whose function will be explained in detail with reference to FIG. 2. The zeroing lever 12 consists of a zeroing lever arm 12*a* and a zeroing lever latch 12*b*, wherein the zeroing lever arm 12*a* is mounted rotatably around the zeroing lever arm pivot point 19, and the zeroing lever latch 12*b* is connected for rotating about the zeroing lever latch pivot point 20 to the zeroing lever arm 12*a*. The zeroing lever latch 12*b* is in one plane with the heart-shaped minute zeroing cam 17 and the heart-shaped second zeroing cam 16. The heart-shaped minute zeroing cam 17 is firmly connected to the zeroing wheel 8 via the zeroing shaft 11, while the heart-shaped second zeroing cam 16 is firmly connected to the second wheel 3 via the second shaft 4. To stop the chronograph, the swivel drive (not shown) is brought out of engagement with the second wheel 3 by means of a pushbutton (not shown). In addition, operating the pushbutton causes a suitable holding means (not shown), such as a locking bolt, to be in engagement with the second wheel 3. Operating the pushbutton causes the center second hand 1 and the center minute hand 2 to stop.

To reset the chronograph 100 (see FIG. 3) to its zero position 106 (see FIG. 3) for another timing, the locking bolt (not shown) is brought out of engagement with the second wheel 3 by means of another pushbutton (not shown). At the same time, operating the pushbutton swivels the zeroing lever arm 12*a* and thus also the zeroing lever latch 12*b* by a small amount in their respective plane, whereby the zeroing lever latch 12*b* comes into end-to-end contact both with the heart-shaped minute zeroing cam 17 and with the heart-shaped second zeroing cam 16. As a result, the heart-shaped minute zeroing cam 17 and the zeroing wheel 8 firmly connected to the heart-shaped minute zeroing cam 17 via the zeroing shaft 11 as well as the heart-shaped second zeroing cam 16 and the second wheel 3 firmly connected to the heart-shaped second zeroing cam 16 via the second shaft 4 are turned until they are back in their zero position. This is the case when the first angled end 13 of the zeroing lever latch 12*b* rests against the flattened area 17' of the heart-shaped minute zeroing cam 17 and the second angled end 14 of the zeroing lever latch 12*b* rests against the flattened area 16' of the heart-shaped second zeroing cam 16. The movement of the zeroing wheel 8 into its zero position also moves the drive wheel 7, the pulse-transmitting wheel 9, the minute wheel 10, and the center minute hand 2 into their respective zero positions. Similarly, the movement of the second wheel 3 into its zero position also moves the center second hand 1 into its zero position.

Figure 3:
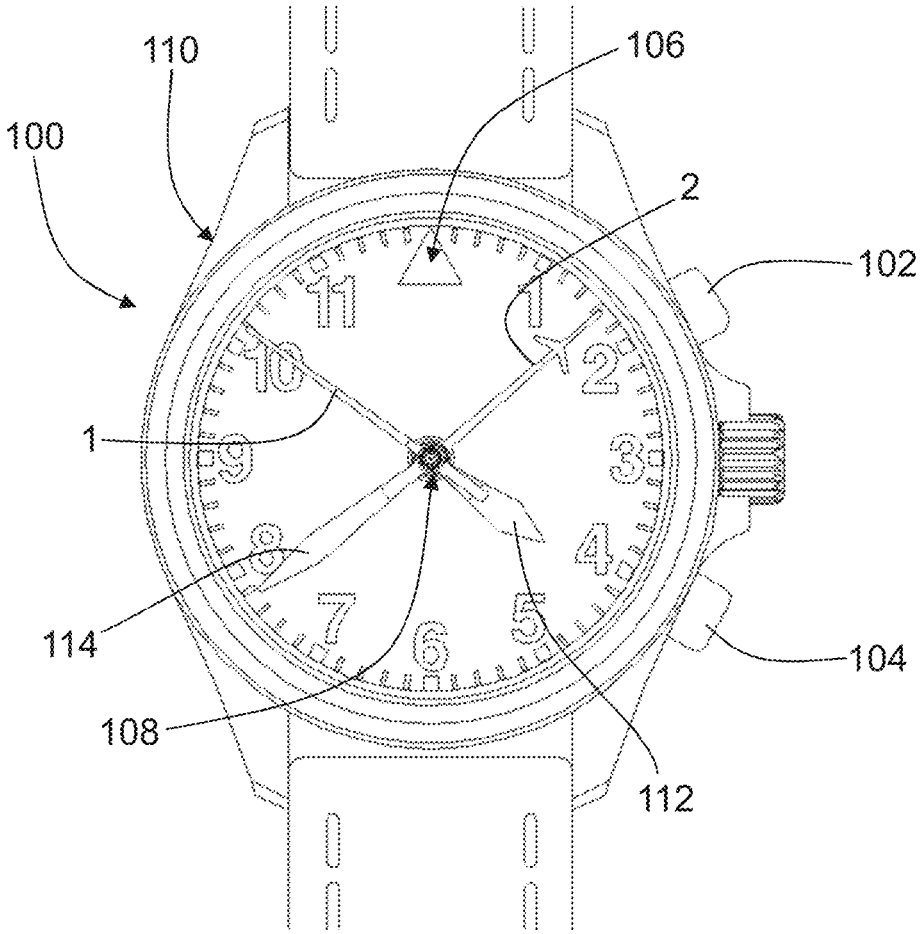
FIG. 3 shows a plan view of a chronograph in which the invention is implemented.

FIG. 3 shows a plan view of a chronograph 100 in which the invention is implemented. The chronograph 100 has a housing 110 in which the clockwork (not shown) is housed. The hours are indicated by an hour hand 112, and the minutes are indicated by a minute hand 114. The center minute hand 2 and the center second hand 1, which move about a joint axis 108 shared by the hour hand 112 and the minute hand 114, are provided to measure the minutes and seconds elapsed since a starting point in time. A start/stop pushbutton 102 is provided to start or stop the stopwatch function. A reset pushbutton 104 is provided to move the center minute hand 2 and the center second hand 1 back to a zero position 106.

Figure 4:
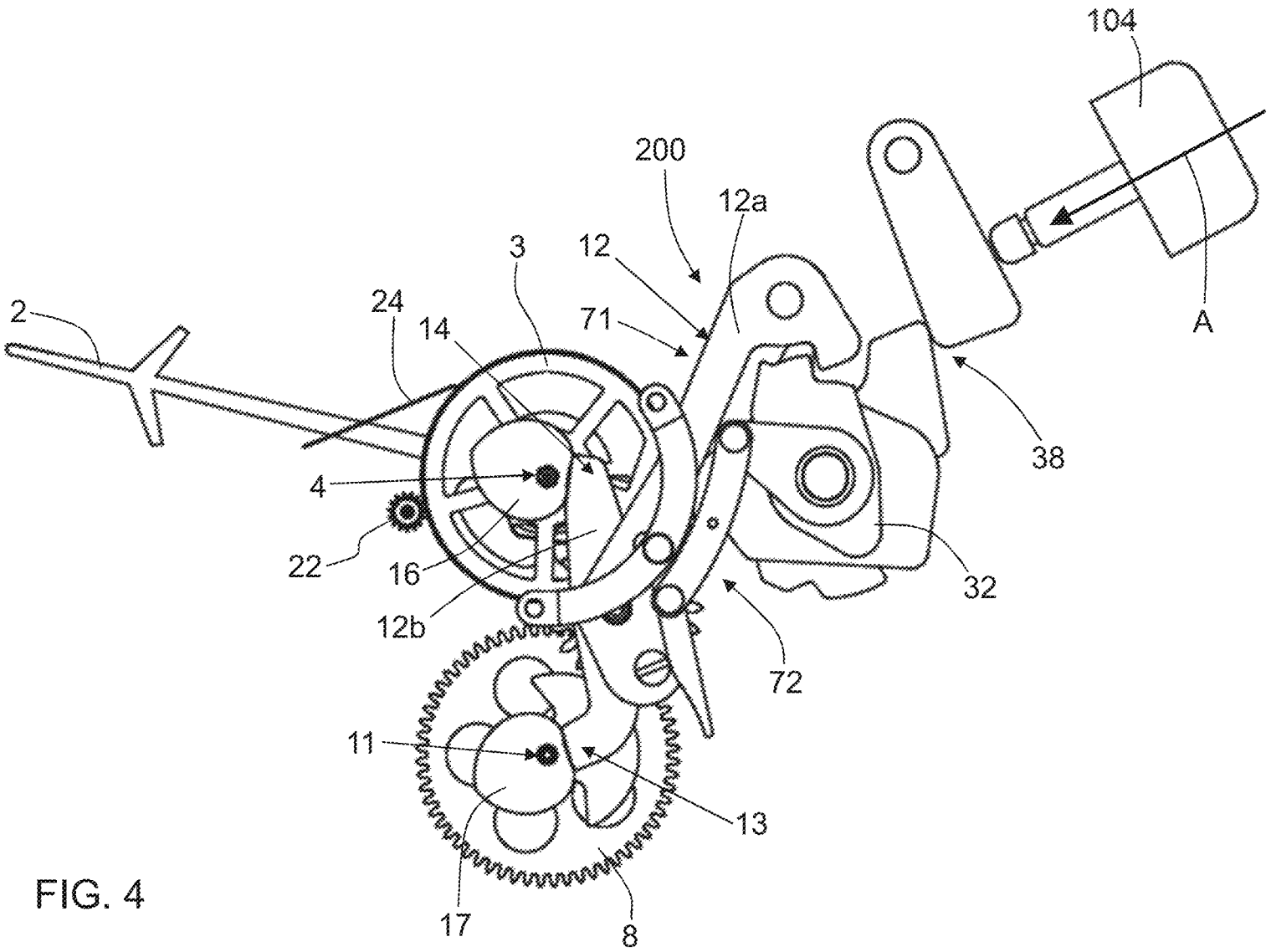
FIG. 4 shows a view from the bottom of a portion of the internal structure of a chronograph from FIG. 3, wherein the reset pushbutton is shown in an operative connection with the zeroing device according to the invention.

FIG. 4 shows a view from the bottom of a portion of the internal structure of a chronograph 100 from FIG. 3. The reset pushbutton 104 is shown here in an operative connection with the zeroing device 200 according to the invention. The zeroing device 200 includes a first zeroing unit 71 and a second zeroing unit 72, which are arranged in different planes E71 and E72 that are offset in the Z coordinate direction (see FIG. 10) in the chronograph 100. As described in FIG. 3, the reset pushbutton 104 can be operated from outside the housing 110 of the chronograph 100. By operating the reset pushbutton 104 in an axial direction A, its movement is transmitted via a transmission mechanism 38 to a control cam 32. The movement of the reset pushbutton 104 is converted into a swiveling or rotational movement of the control cam 32.

Figure 5:
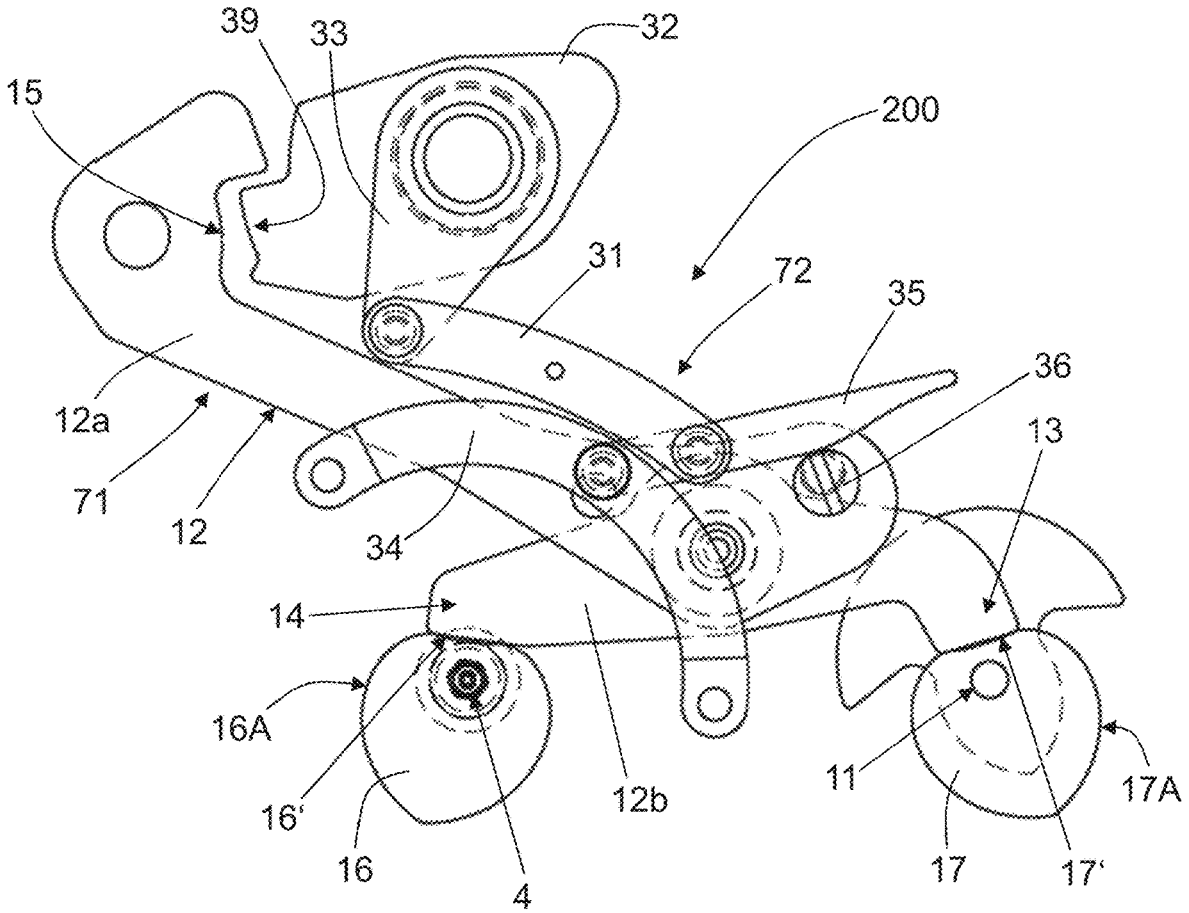
FIG. 5 shows detailed view of the zeroing device according to the invention.

The swiveling or rotational movement of the control cam 32 also transmits a movement or force to the first zeroing unit 71 and the second zeroing unit 72 of the zeroing device 200. FIG. 5 shows an enlarged view of the structure of the zeroing device 200 and the interaction of the first zeroing unit 71 and the second zeroing device 72. A first zeroing unit 71 consists of a zeroing lever 12 having a zeroing lever arm 12*a* and a zeroing lever latch 12*b*. The zeroing lever latch 12*b* has a first end 13 and a second end 14.

As can be derived from FIGS. 4 and 5, the first end 13 of the zeroing lever latch 12*b* of the first zeroing unit 71 is angled. The second end 14 of the zeroing lever latch 12*b* is flattened. In a zero position, in which the center minute hand 2 and the center second hand 1 (not visible in the view of FIG. 5) are exactly superimposed on each other and are aligned with the zero position 106 (see FIG. 3), the first, angled end 13 of the zeroing lever latch 12*b* rests against a flattened area 17' of a heart-shaped minute zeroing cam 17 and the second, flattened end 14 of the zeroing lever latch 12*b* rests against the flattened area 16' of the heart-shaped second zeroing cam 16. Likewise, the control cam 32 is arranged in relation to a U-shaped receptacle 15 of the zeroing lever arm 12*a* in such a manner that a cam contour 39 of the control cam 32 rests in the U-shaped receptacle 15 and does not contact the zeroing lever arm 12*a*.

The second zeroing unit 72 includes a pendulum rod 31, a hinge support 34, and a joint rod 35. The pendulum rod 31 is rotatably attached to a cam 33 and to the joint rod 35. The joint rod 35 is rotatably attached to the hinge support 34 and rests against an eccentric 36 of the zeroing lever 12. The hinge support 34 itself is mounted in a stationary manner.

As can be derived from the view shown in FIG. 4 (view from the bottom of a portion of the chronograph 100) and from the view shown in FIG. 5 of the zeroing device 200, the heart-shaped minute zeroing cam 17 is firmly connected to the zeroing wheel 8 via a zeroing shaft 11. The heart-shaped second zeroing cam 16 is firmly connected to the second wheel 3 via a second shaft 4. By bringing the angled end 13 of the zeroing lever latch 12*b* to rest against a point of the outer contour 17A of the heart-shaped minute zeroing cam 17 and by bringing the flattened end 14 of the zeroing lever latch 12*b* to rest against a point of the outer contour 16A of the heart-shaped second zeroing cam 16 in the zeroing process, the flattened area 17' of the heart-shaped minute zeroing cam 17 comes to rest against the angled end 13 of the zeroing lever latch 12*b* and the flattened area 16' of the heart-shaped second zeroing cam 16 comes to rest against the second, flattened end 14 of the zeroing lever latch 12*b* and in this way sets the center second hand 1 and the center minute hand 2 to the zero position 106. The zeroing wheel 8 and the second wheel 3 are turned accordingly to achieve the zero position 106.

When the start/stop pushbutton 102 shown in FIG. 3 is pushed, a drive gear wheel 22 (see FIG. 4) gets into meshing engagement with the second wheel 3, such that the center second hand 1 (not shown in FIG. 4) is moved. A minute counting catch 24 is associated with the minute wheel 10 (not visible here, since the minute wheel is under the second wheel 3)

Figure 6:
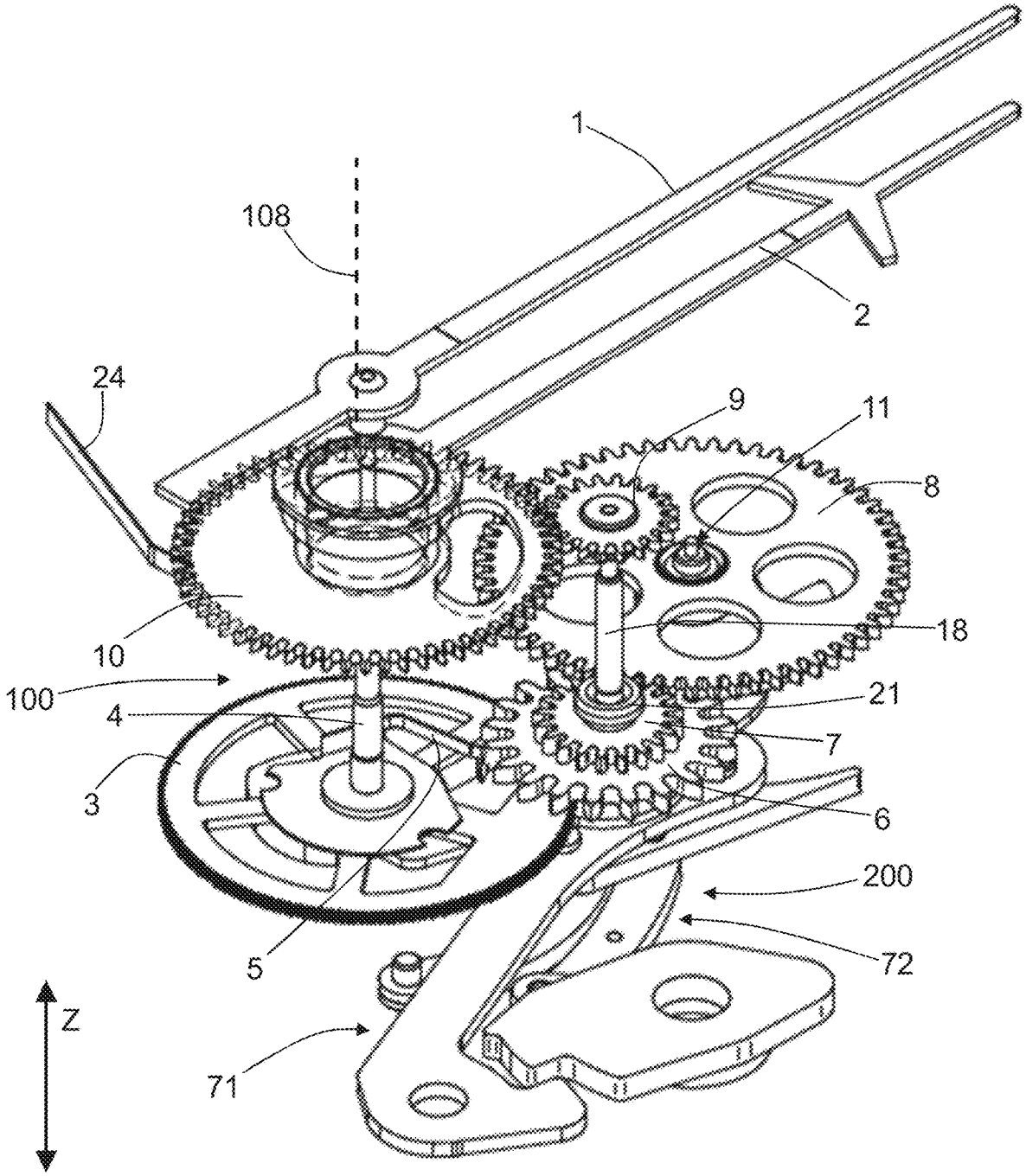
FIG. 6 shows a perspective view from the top of a portion of the internal structure of a chronograph including the zeroing device according to the invention, wherein the hands are in their initial position (zero position).

FIG. 6 shows a perspective view from the top of a portion of the internal structure of a chronograph 100 including the zeroing device 200 according to the invention, wherein the center second hand 1 and the center minute hand 2 are in their initial position (zero position). The center minute hand 2 is firmly connected to the minute wheel 10. The zeroing wheel 8, the pulse-transmitting wheel 9, and the minute wheel 10 are indexed by the drive wheel 7, whereby the center minute hand 2 is eventually advanced by one unit.

The second wheel 3 is driven as described in FIG. 4. The entraining spring 5 is firmly connected to the second wheel 3 and interacts with the pulse-receiving wheel 6 at each full revolution of the second wheel 3. The pulse-receiving wheel 6 and the drive wheel 7, which is arranged coaxially above, are firmly connected to the multifunction shaft 18, which itself is mounted in a bottom plate (not shown) arranged above the drive wheel 7 in the ruby bearing stone 21. Also firmly connected to the multifunction shaft 18 is the pulse-transmitting wheel 9, which is in constant engagement with the minute wheel 10 in such a manner that the minute wheel 10 and thus the center minute hand 2 advance by one position at each full revolution of the second wheel 3.

The zeroing wheel 8, which is firmly connected to the zeroing shaft 11, is in constant engagement with the drive wheel 7. The zeroing wheel 8, the pulse-transmitting wheel 9, and the minute wheel 10 are indexed by the drive wheel 7, whereby the center minute hand 2 is eventually advanced by one unit. The center second hand 1 is firmly connected to the second shaft 4, wherein the second shaft 4 itself is firmly connected to the second wheel 3. The second shaft 4 penetrates the center of the minute wheel 10. The center second hand 1 and the center minute hand 2 are thus configured to be rotatable about a joint axis 108.

The zeroing device 200 with the first zeroing 71 and the second zeroing unit 72 is located under the clockwork (such as the second wheel 3 and the pulse-receiving wheel 6) and offset in the Z coordinate direction Z.

Figure 7:
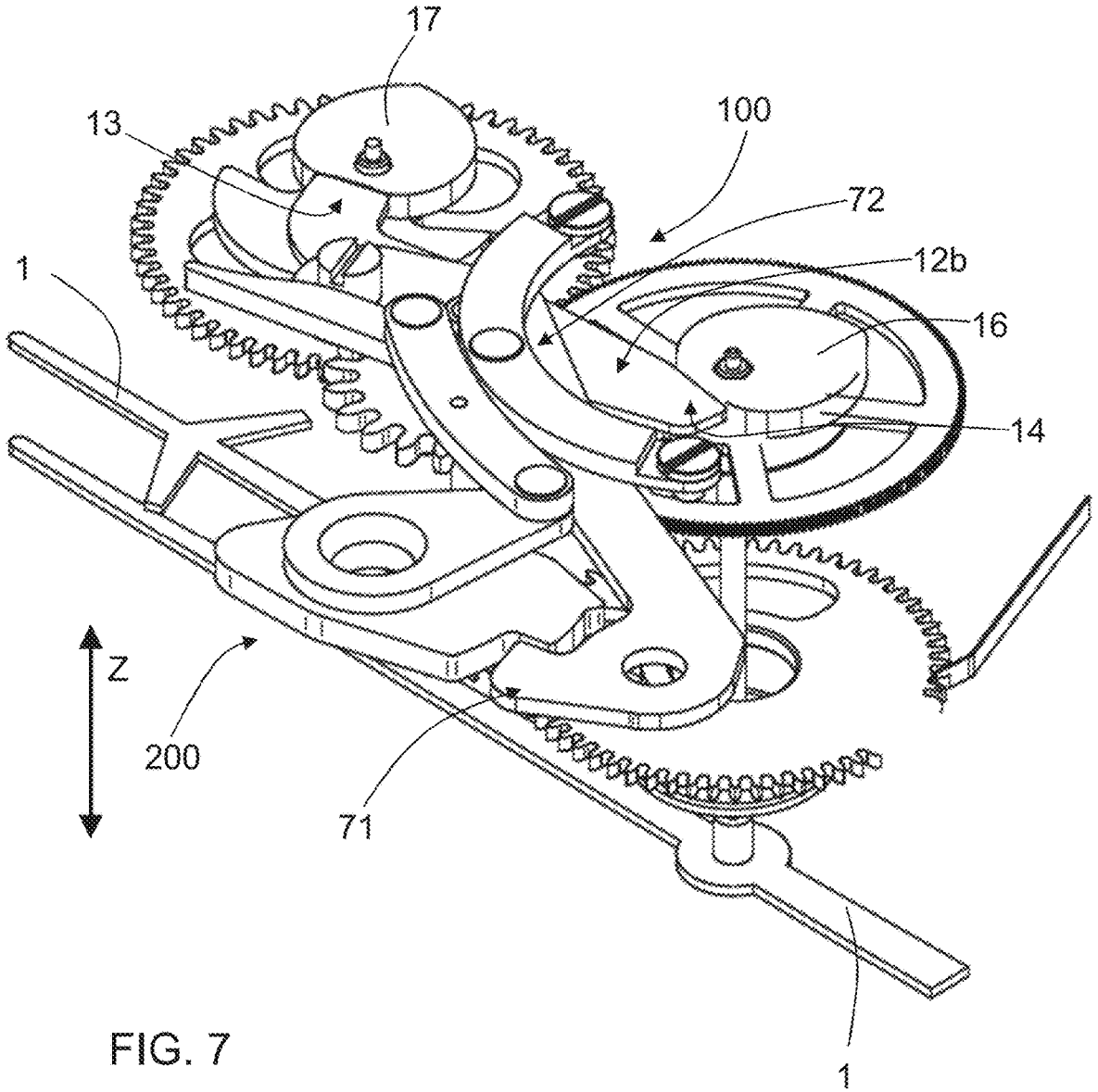
FIG. 7 shows a perspective view from the bottom of a portion of the internal structure of a chronograph including the zeroing device according to the invention, wherein the hands are in their initial position (zero position).

FIG. 7 shows a perspective view from the bottom of a portion of the internal structure of a chronograph 100. The figure illustrates the spatial configuration of the zeroing device 200 according to the invention. The center second hand 1 and the center minute hand 2 are in their initial position (zero position 106, see FIG. 3). The first zeroing unit 71 and the second zeroing unit 72 of the zeroing device 200 according to the invention are arranged at an offset in the Z coordinate direction Z but still in an operative mechanical connection. In the zero position 106, the center second hand 1 and the center minute hand 2 are superimposed on each other, and the first end 13 of the zeroing lever latch 12*b* of the first zeroing unit 71 rests against the heart-shaped minute zeroing cam 17, while its second end 14 rests against the heart-shaped second zeroing cam 16.

Figure 8:
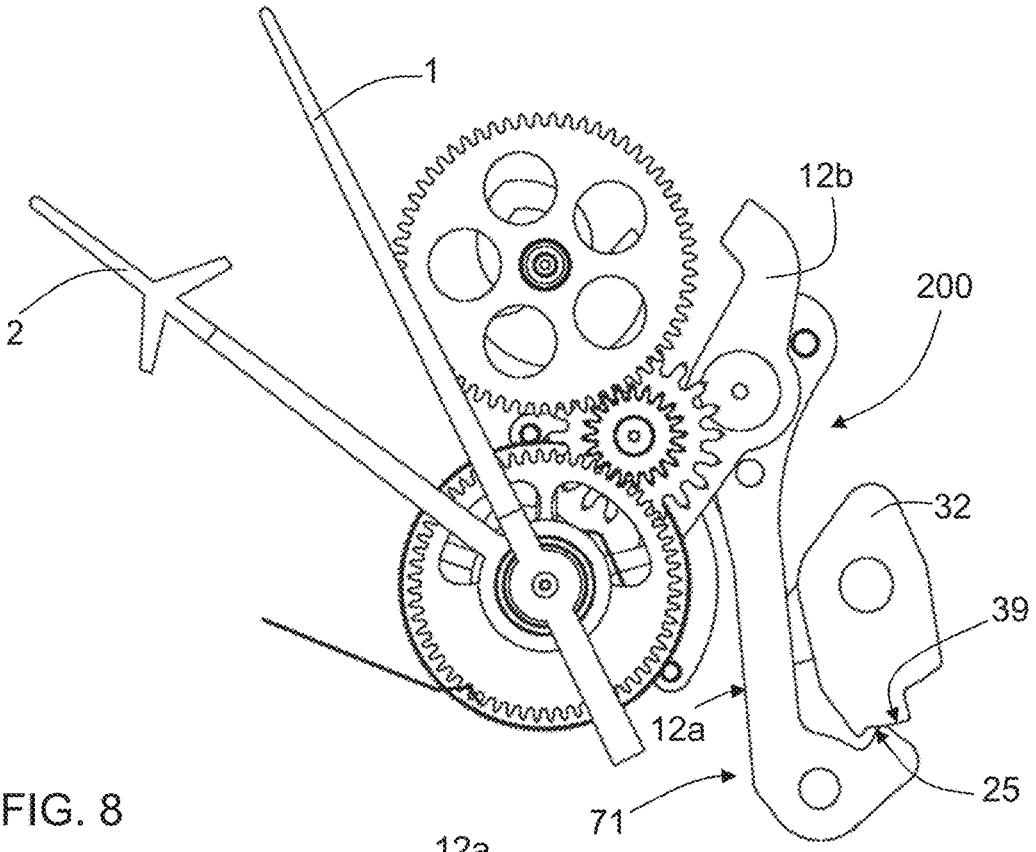
FIG. 8 shows a plan view of a portion of the internal structure of a chronograph including the zeroing device according to the invention, wherein the hands take the time (stopwatch position).
Figure 9:
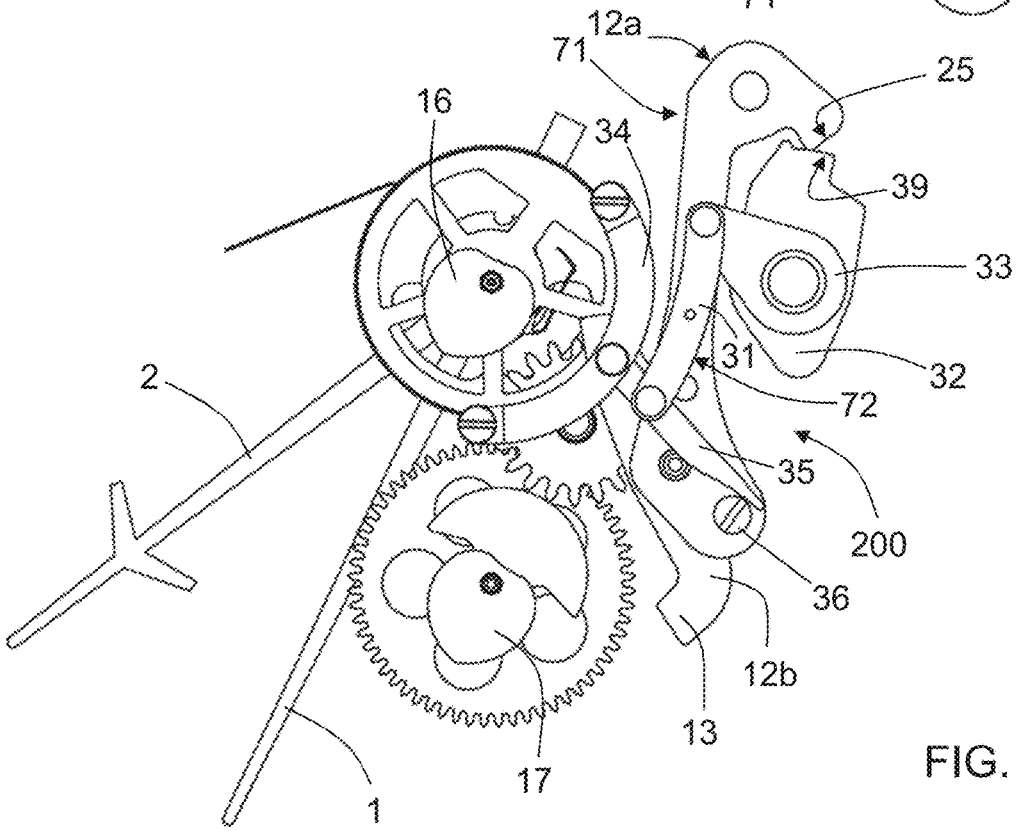
FIG. 9 shows a view from the bottom of a portion of the internal structure of a chronograph including the zeroing device according to the invention, wherein the hands take the time (stopwatch position).

FIG. 8 and FIG. 9 illustrate the position of the zeroing device 200 according to the invention when the start/stop pushbutton 102 (see FIG. 3) was pushed. The zeroing lever latch 12*b* of the first zeroing unit 71 is swiveled in such a manner that the first end 13 is not in an operative connection with the heart-shaped minute zeroing cam 17 and the second end 14 is not in an operative connection with the heart-shaped second zeroing cam 16. The cam contour 39 of the control cam 32 is now in contact with a contour 25 of the zeroing lever arm 12*a*. The position of the second zeroing unit 72 in relation to the first zeroing unit 71 can be derived from FIG. 9. The pendulum rod 31 is rotatably connected to the cam 33 and to the joint rod 35. The joint rod 35 is also rotatably connected to the hinge support 34. Since the joint rod 35 rests against the eccentric 36, the zeroing lever latch 12*b* is biased in such a manner that the zeroing of the center second hand 1 and the center minute hand 2 is supported by an additional force.

Figure 10:
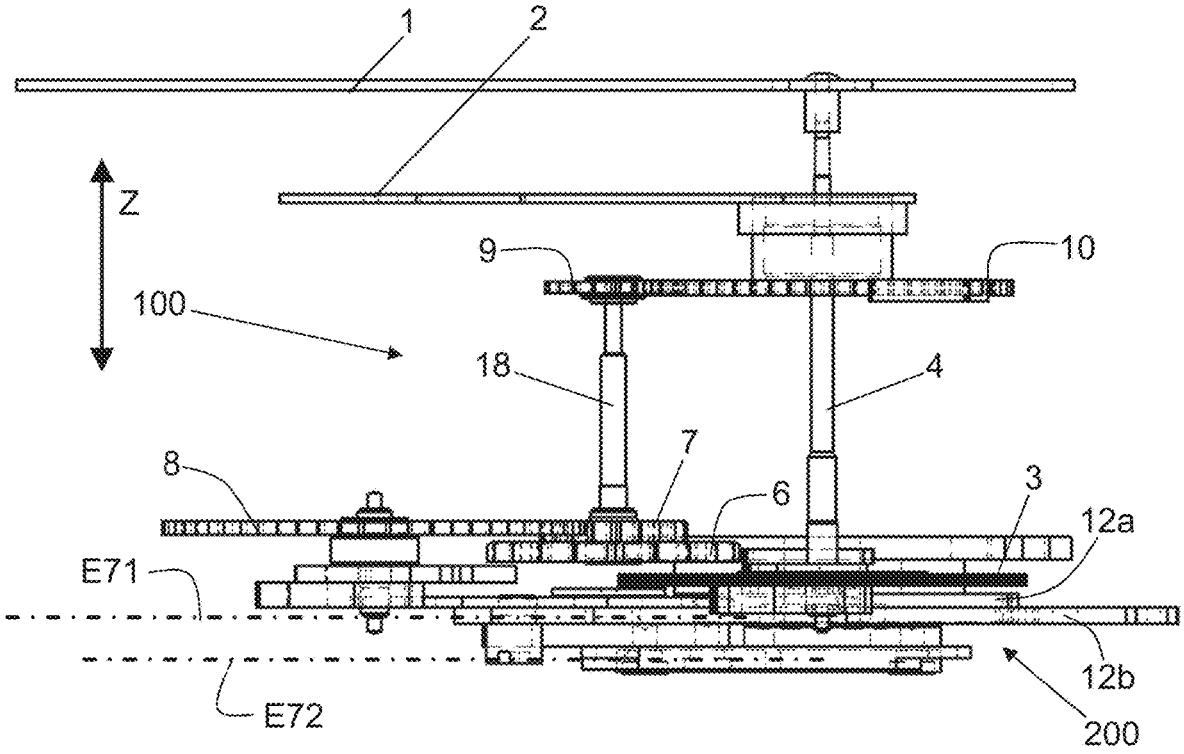
FIG. 10 shows a side view of a portion of the internal structure of a chronograph including the zeroing device according to the invention.

FIG. 10 shows a side view of a portion of the internal structure of a chronograph 100 including the zeroing device 200 according to the invention. The figure is intended to illustrate the arrangement of the individual elements of the chronograph 100 and the zeroing device 200 in the Z coordinate direction Z. The zeroing device 200 according to the invention is provided underneath the elements of the chronograph 100 in the Z coordinate direction Z.

The center second hand 1 is arranged above the center minute hand 2 in the Z coordinate direction Z. The pulse-transmitting wheel 9 and the minute wheel 10 are in meshing engagement and arranged below the center minute hand 2 in the Z coordinate direction Z. The other elements, such as the second wheel 3, entraining spring 5 (see FIG. 3), pulse-receiving wheel 6, drive wheel 7, or zeroing wheel 8 of the chronograph 100 are arranged below the pulse-transmitting wheel 9 and the minute wheel 10 in the Z coordinate direction Z.

The zeroing device 200 is arranged below the second wheel 3, pulse-receiving wheel 6, drive wheel 7, and zeroing wheel 8 in the Z coordinate direction Z. The first zeroing unit 71 consisting of the zeroing lever 12, zeroing lever arm 12*a*, and zeroing lever latch 12*b* is substantially arranged in a plane E71. The second zeroing unit 72 is substantially arranged in a plane E72. The plane E72 of the second zeroing unit 72 is located below a plane E71 of the first zeroing unit 71 in the Z coordinate direction Z.

The above description of the chronograph 100 only describes those mechanical elements that are required for the stopwatch function of the chronograph 100. All other elements of the chronograph 100 which are required for indicating the time by means of the hour hand 112 and the minute hand 114 (see FIG. 3) were not shown for clarity reasons. Furthermore, the configuration of a clockwork for indicating the time is well known to a person skilled in the art.

Figure 11:
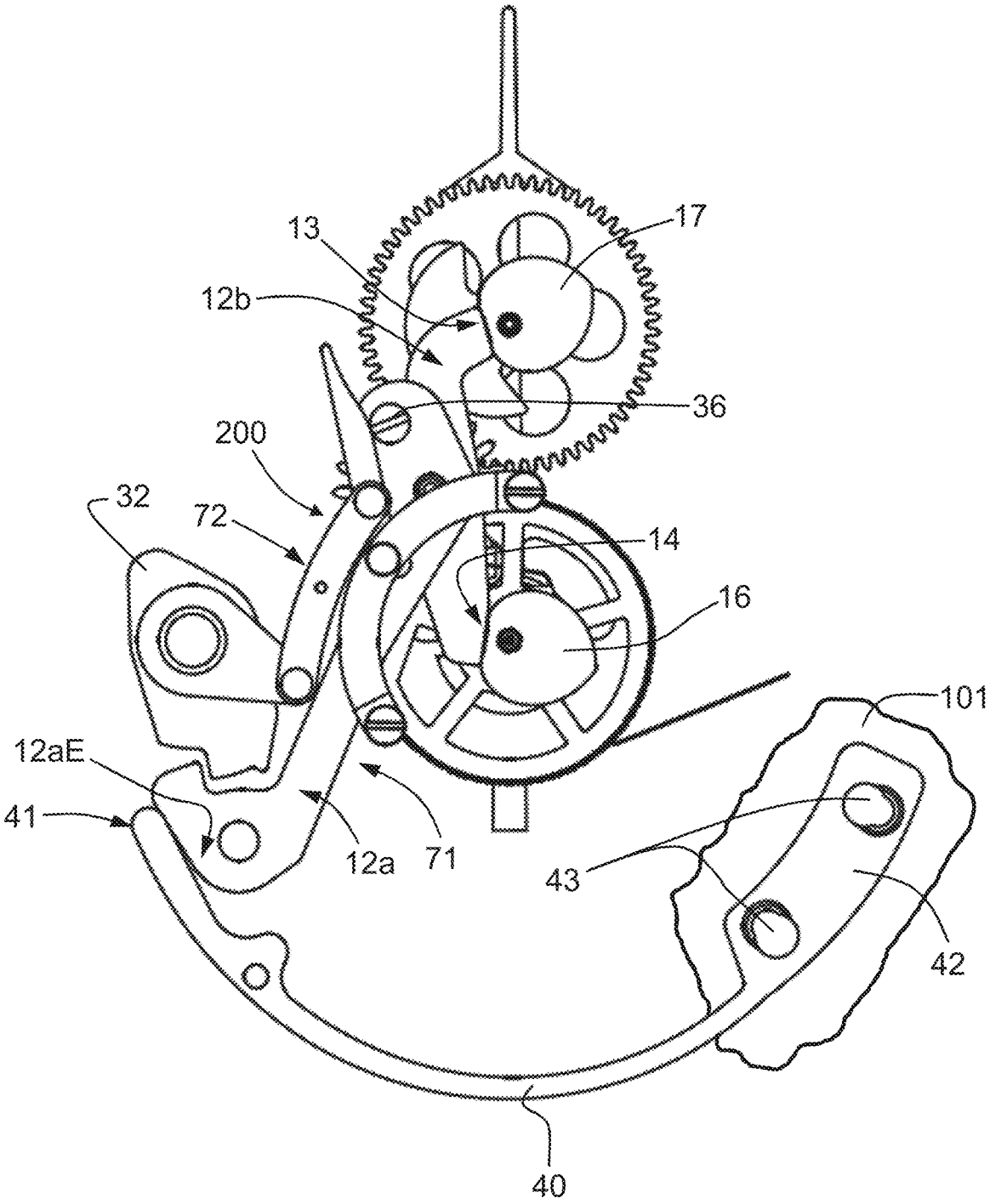
FIG. 11 shows a plan view from the bottom of a portion of the internal structure of a chronograph including the zeroing device according to the invention, wherein a spring for spring-loading the zeroing lever is shown in addition to the view from FIG. 7.

FIG. 11 shows a plan view from the bottom of a portion of the internal structure of a chronograph 100 including the zeroing device according to the invention, wherein a compression spring 40 for spring-loading the zeroing lever 12 is shown in addition to the view from FIG. 7. The zeroing device 200 according to the invention makes it possible that the center second hand 1 and the center minute hand 2 are in their initial position (zero position 106, see FIG. 3). The first end 13 of the zeroing lever latch 12*b* of the first zeroing unit 71 rests against the heart-shaped minute zeroing cam 17, while its second end 14 rests against the heart-shaped second zeroing cam 16. To ensure that this contact is always made in the zero position 106 of the center second hand 1 and the center minute hand 2, a first free end 41 of the compression spring 40 rests against a free end 12*a*E of the zeroing lever arm 12*a*, which end is also in operative connection with the control cam 32. The compression spring 40 thus applies a pressure to the free end 12*a*E of the zeroing lever arm 12*a*, which pressure brings the first end 13 and the second end 14 of the zeroing lever latch 12*b* into an operative connection with the respective flattened areas 16' and 17' of the heart-shaped second zeroing cam 16 and the heart-shaped minute zeroing cam 17. A fastening end 42 of the compression spring 40 is connected via at least one mounting means 43 to a bottom plate 101 of the clockwork (not shown) of the chronograph 100.

Figure 12:
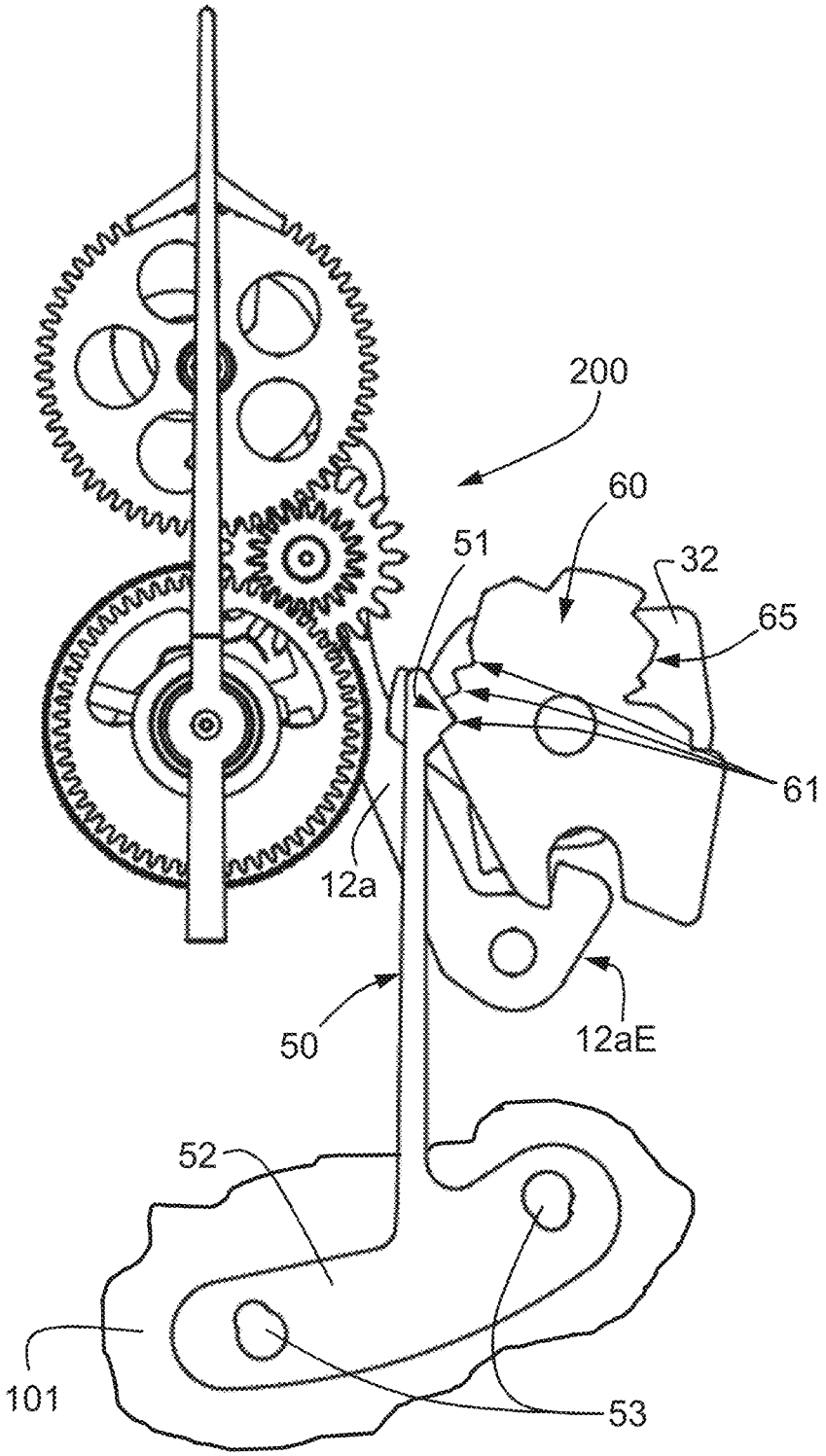
FIG. 12 shows a plan view from the top of a portion of the internal structure of a chronograph including the zeroing device according to the invention, wherein a cam with a spring catch is shown in addition to the view from FIG. 8.

The view shown in FIG. 12 is a plan view from the top onto a portion of the internal structure of a chronograph 100 of the zeroing device 200 according to the invention. In addition to the view from FIG. 8, this view shows a latch cam 60 above the control cam 32, which latch cam interacts with a latch spring 50. The latch cam 60 is floatingly mounted to the control cam 32. The latch cam 60 is held in position in that a V-shaped end 51 of the latch spring 50 engages in V-shaped latching recesses 61 of the latch cam 60. The zeroing linkage can be pressurized by rotating the latch cam 60. The latch cam 60 is rotated through interaction of a contour 65 of the latch cam 60 with the start/stop pushbutton 102 and/or the reset pushbutton 104 (see FIG. 3).

The latch spring 50 tries to fully engage in the V-shaped latching recesses 61 and slides along the inclination of the V-shaped latching recesses 61. This applies a pressure to one side of the V-shaped latching recesses 61, which results in a rotational movement of the latch cam 60. The rotational movement ends when the V-shaped end 51 of the latch spring 50 centrally latches into the respective V-shaped latching recess 61. If the V-shaped end 51 of the latch spring 50 does not centrally latch into the V-shaped latching recesses 61, the latch spring 50 will try to turn the latch cam 60 away in one direction. The latch cam 60 applies permanent pressure to the second zeroing unit 72 (see FIG. 11), which unit presses onto the zeroing lever arm 12*a* in its end position via the eccentric 36 (see FIG. 11). This pressure applied to the second zeroing unit 72 can likewise be generated by manual zeroing, which is performed by manually applying radial pressure onto the latch cam 60 via the reset pushbutton 104. Both types of pressure applied to the second zeroing unit 72 or the zeroing lever arm 12*a*, respectively, can act simultaneously or separately. A fastening end 52 of the latch spring 50 is connected via at least one mounting means 53 to a bottom plate 101 of the clockwork (not shown) of the chronograph 100.

While the invention is described with reference to exemplary embodiments, it is not intended that these embodiments describe all possible forms of the invention. Instead, the words used in the description should be interpreted as being descriptive rather than limiting, and it is understood that various changes and modifications can be made without deviating from the scope of the invention. In addition, the features of different embodiments can be combined to form other embodiments of the invention.

LIST OF REFERENCE SYMBOLS

1 Center second hand
2 Center minute hand
3 Second wheel
4 Second shaft
5 Entraining spring
6 Pulse-receiving wheel
7 Drive wheel
8 Zeroing wheel
9 Pulse-transmitting wheel
10 Minute wheel
11 Zeroing shaft

12 Zeroing lever
12*a* Zeroing lever arm
12*a*E Free end
12*b* Zeroing lever latch
13 First end
14 Second end
15 U-shaped receptacle
16 Heart-shaped second zeroing cam
16' Flattened area
16A Outer contour
17 Heart-shaped minute zeroing cam
17' Flattened area
17A Outer contour
18 Multifunction shaft
19 Zeroing lever arm pivot point
20 Zeroing lever latch pivot point
21 Ruby bearing stone
22 Drive gear wheel
24 Minute counting catch
25 Contour
31 Pendulum rod
32 Control cam
33 Cam
34 Hinge support
35 Joint rod
36 Eccentric
38 Transmission mechanism
39 Cam contour
40 Compression spring
41 Free end
42 Fastening end
43 Mounting means
50 Latch spring
51 V-shaped end
52 Fastening end
53 Mounting means
60 Latch cam
61 Latching recess
65 Contour
71 First zeroing unit
72 Second zeroing unit
100 Chronograph
101 Bottom plate
102 Start/stop pushbutton
104 Reset pushbutton
106 Zero position
108 Joint axis
110 Housing
112 Hour hand
114 Minute hand
200 Zeroing device
A axial direction
E71 Plane
E72 Plane
Z coordinate direction

The invention claimed is:

1. A zeroing device (200) for zeroing of a center minute hand and a center second hand of a chronograph, the zeroing device (200) including a first zeroing unit (71), which consists of a zeroing lever (12) having a zeroing lever arm (12*a*) and a zeroing lever latch (12b), wherein the zeroing lever latch (12b) has a first end (13) and a second end (14) and wherein a zeroing of a center minute hand and a center second hand can be achieved by operating a reset pushbutton;

characterized in that a second zeroing unit (72) is arranged at an offset to the first zeroing unit (71) in a Z coordinate direction (Z) and is in operative connection with the first zeroing unit (71) wherein the second zeroing (72) unit indirectly applies a force from the reset pushbutton to the zeroing lever latch (12*b*) of the first zeroing unit (71) and wherein the first zeroing unit (71) and the second zeroing unit (72) are both connected to the reset pushbutton via a transmission mechanism (38) to be simultaneously operated by pressing the reset pushbutton once to achieve a zeroing of the center minute hand and the center second hand.

2. The zeroing device (200) according to claim 1, wherein the second zeroing unit (72) includes a pendulum rod (31), a hinge support (34), and a joint rod (35), wherein the pendulum rod (31) is rotatably attached to a cam (33) and to the joint rod (35) and wherein the joint rod (35) is rotatably attached to the hinge support (34) and rests against an eccentric (36) of the zeroing lever (12).

3. The zeroing device (200) according to claim 2, wherein the joint rod (35) is mounted in a stationary manner.

4. The zeroing device (200) according to claim 2, wherein the cam (33) sits on a control cam (32) and is connected to the same in a stationary manner, and wherein the control cam (32) interacts with the zeroing lever arm (12*a*) of the zeroing lever (12).

5. The zeroing device (200) according to claim 1, wherein the first end (13) of the zeroing lever latch (12*b*) is angled and the second end (14) of the zeroing lever latch (12*b*) is flattened, wherein, in a zero position (106), the first, angled end (13) of the zeroing lever latch (12*b*) rests against a flattened area (17') of a minute zeroing heart cam (17) of a minute wheel (10) and the second, flattened end (14) of the zeroing lever latch (12*b*) rests against the flattened area (16') of the second zeroing heart cam (16) of a second wheel (3).

6. The zeroing device (200) according to claim 5, wherein a reset pushbutton (104) is provided, which, when operated, causes a rotational movement of the control cam (32) in an axial direction (A) via a transmission mechanism (38).

7. The zeroing device (200) according to claim 6, wherein a cam contour (39) of a control cam (32) engages in a U-shaped receptacle (15) on the zeroing lever arm (12*a*) of the zeroing lever (12) by a rotational movement of the control cam (32) and the rotational movement of the control cam (32) applies a force via a pendulum rod (31) and a joint rod (35) to an eccentric (36) of the zeroing lever (12) in such a manner that the first, angled end (13) of the zeroing lever latch (12*b*) rests against the flattened area (17') of the minute zeroing heart cam (17) of the minute wheel (10) and the second, flattened end (14) of the zeroing lever latch (12*b*) rests against the flattened area (16') of the second zeroing heart cam (16) of the second wheel (3).

8. A chronograph (100), comprising:

a second wheel (3) having an entraining spring (5), a pulse-receiving wheel (6), wherein the entraining spring (5) is configured for engaging in the pulse-receiving wheel (6), a zeroing wheel (8), wherein the zeroing wheel (8) is in constant engagement with the drive wheel (7), a pulse-transmitting wheel (9), a minute wheel (10), wherein the minute wheel (10) is in constant engagement with the pulse-transmitting wheel (9), and a center minute hand (2) is firmly connected to the minute wheel (10), a second shaft (4), wherein the second wheel (3) and a center second hand (1) are firmly connected to the second shaft (4), a multifunction shaft (18), which is aligned parallel to the second shaft (4), wherein the pulse-receiving wheel (6) and the pulse-transmitting wheel (9) are firmly coaxially connected to the multifunction shaft (18);

a first zeroing unit (71), which consists of a zeroing lever (12) having a zeroing lever arm (12*a*) and a zeroing lever latch (12*b*), wherein the zeroing lever latch (12*b*) comprises a first end (13) and a second end (14) and wherein the first end (13) can be brought into and out of an operative connection with a minute zeroing heart cam (17) of the zeroing wheel (8) and the second end (14) can be brought into and out of an operative connection with a second zeroing heart cam (16) of the second wheel (3);

characterized in that a second zeroing unit (72) is arranged above the first zeroing unit (71) in such a manner that the second zeroing unit (72) supports the first zeroing unit (71) when the reset pushbutton (104) is operated.

9. The chronograph (100) according to claim 8, wherein the minute zeroing heart cam (17) is firmly connected to the zeroing wheel (8) via a zeroing shaft (11), while the second zeroing heart cam (16) is firmly connected to the second wheel (3) via the second shaft (4).

10. The chronograph (100) according to claim 8, wherein the second zeroing unit (72) includes a pendulum rod (31), a hinge support (34), and a joint rod (35), wherein the pendulum rod (31) is rotatably attached to a cam (33) and to the joint rod (35) and wherein the joint rod (35) is rotatably attached to the hinge support (34) and rests against an eccentric (36) of the zeroing lever (12).

11. The chronograph (100) according to claim 10, wherein the joint rod (35) is mounted in a stationary manner.

12. The chronograph (100) according to claim 10, wherein the cam (33) sits on a control cam (32) and is connected to the same in a stationary manner, and wherein the control cam (32) interacts with the zeroing lever arm (12*a*) of the zeroing lever (12).

13. The chronograph (100) according to claim 8, wherein the first end (13) of the zeroing lever latch (12*b*) is angled and the second end (14) of the zeroing lever latch (12*b*) is flattened, wherein, in a zero position (106), the first, angled end (13) of the zeroing lever latch (12*b*) rests against a flattened area (17') of a minute zeroing heart cam (17) of the minute wheel (10) and the second, flattened end (14) of the zeroing lever latch (12*b*) rests against the flattened area (16') of the second zeroing heart cam (16) of the second wheel (3).

14. The chronograph (100) according to claim 13, wherein a reset pushbutton (104) is provided, which, when operated, causes a rotational movement of a control cam (32) in an axial direction (A) via a transmission mechanism (38) of the chronograph (100).

15. The chronograph (100) according to claim 14, wherein a cam contour (39) of the control cam (32) engages in a U-shaped receptacle (15) on the zeroing lever arm (12*a*) of the zeroing lever (12) by a rotational movement of the control cam (32) and the rotational movement of the control cam (32) applies a force via a pendulum rod (31) and a joint rod (35) to an eccentric (36) of the zeroing lever (12) in such a manner that the first, angled end (13) of the zeroing lever latch (12*b*) rests against the flattened area (17') of the minute zeroing heart cam (17) of the minute wheel (10) and the second, flattened end (14) of the zeroing lever latch (12*b*) rests against the flattened area (16') of the second zeroing heart cam (17) of the second wheel (3), and wherein the center minute hand (2) and the center second hand (1) are superimposed on each other and point to a zero position (106) of the chronograph (100).

* * * * *